US008493275B2

(12) United States Patent
Roemer

(10) Patent No.: US 8,493,275 B2
(45) Date of Patent: Jul. 23, 2013

(54) WAVEGUIDE RADIATOR, ESPECIALLY FOR SYNTHETIC APERTURE RADAR SYSTEMS

(75) Inventor: Christian Roemer, Immenstaad (DE)

(73) Assignee: Astrium GmbH, Munich (DE)

( * ) Notice: Subject to any disclaimer, the term of this patent is extended or adjusted under 35 U.S.C. 154(b) by 766 days.

(21) Appl. No.: 12/516,996

(22) PCT Filed: Nov. 27, 2007

(86) PCT No.: PCT/DE2007/002139

§ 371 (c)(1),
(2), (4) Date: May 29, 2009

(87) PCT Pub. No.: WO2008/064655

PCT Pub. Date: Jun. 5, 2008

(65) Prior Publication Data

US 2010/0066623 A1 Mar. 18, 2010

(30) Foreign Application Priority Data

Dec. 1, 2006 (DE) ..... 10 2006 057 144

(51) Int. Cl.
*H01Q 13/10* (2006.01)

(52) U.S. Cl.
USPC ..... 343/771; 343/770

(58) Field of Classification Search
USPC ..... 343/770, 771, 700 MS
See application file for complete search history.

(56) References Cited

U.S. PATENT DOCUMENTS

| | | | | |
|---|---|---|---|---|
| 2,914,766 | A | 11/1959 | Butler | |
| 3,524,189 | A | 8/1970 | Jones | |
| 4,409,595 | A | 10/1983 | Park | |
| 4,873,528 | A | 10/1989 | Girard | |
| 5,422,649 | A * | 6/1995 | Huang | 343/700 MS |
| 5,619,216 | A | 4/1997 | Park | |
| 5,831,583 | A * | 11/1998 | Lagerstedt et al. | 343/771 |
| 5,914,694 | A * | 6/1999 | Raab | 343/771 |
| 5,977,924 | A * | 11/1999 | Takei et al. | 343/770 |
| 6,954,183 | B2 | 10/2005 | Solbach | |

FOREIGN PATENT DOCUMENTS

| | | |
|---|---|---|
| DE | 33 10 531 | 4/1986 |
| EP | 0 747 994 | 5/1996 |
| EP | 1 263 086 | 12/2002 |
| FR | 2 555 823 | 3/1982 |

* cited by examiner

*Primary Examiner* — Dieu H Duong
(74) *Attorney, Agent, or Firm* — Greenblum & Bernstein, P.L.C.

(57) ABSTRACT

The invention relates to a waveguide radiator comprising:

Figure 1:
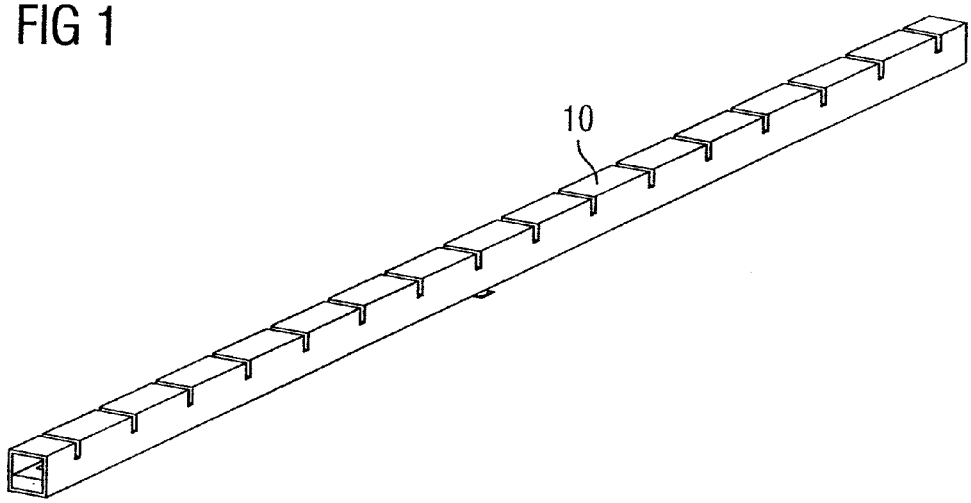

A slotted waveguide (10) with a plurality of slots (14) inserted in the waveguide (10); and An additional inner conductor (12) installed inside the waveguide (10), which inner conductor is shaped in a polarization-dependent manner such that all of the slots (14) of the waveguide (10) can be excited with identical phase and amplitude.

22 Claims, 16 Drawing Sheets

WAVEGUIDE RADIATOR, ESPECIALLY FOR SYNTHETIC APERTURE RADAR SYSTEMS

The invention relates to a waveguide radiator, in particular for synthetic aperture radar systems, according to claim 1.

Waveguide radiators or phased array radiators or radiator groups (radiators) are used, for example, in phased array antennas of synthetic aperture radar (SAR) systems with single and dual polarization. Hitherto so-called microstrip patch antennas or slotted waveguide antennas were used as radiators. The former exhibit high electrical losses and, due to their electrical feed network, cannot be efficiently realized in greater radiator lengths than approx. seven wavelengths (in X-band approx. 20 cm). The latter require a very high manufacturing accuracy due to their electrically resonant behavior and can be reproduced as dual polarized radiator groups only with great expenditure. For example, waveguides with interior ridges for vertical polarization or inserted tilted wires for horizontal polarization and complicated waveguide coupling devices are necessary.

The object of the present invention is therefore to propose an efficient waveguide radiator, in particular one that can be implemented cost-effectively, in particular for SAR systems.

This object is attained with a waveguide radiator, in particular for SAR systems, with the features of claim 1. The dependent claims show further embodiments of the invention.

An essential concept of the invention lies in using a slotted waveguide as a radiator, in which an additional inner conductor, a so-called barline, is attached. This inner conductor is in particular specially shaped in a polarization-dependent manner in order to excite all of the slots of the waveguide in phase. To fix the inner conductor, a layer of dielectric can be applied in the waveguide, on the upper side of which dielectric the inner conductor is mounted, for example, by adhesion. A coupling can take place in the radiator center through a direct coaxial junction, in which the core of a coupled coaxial cable is connected to the inner conductor.

The phased array radiator according to the invention is particularly well suited for phased array antennas of SAR systems with single and dual polarization, in particular for radiators in satellite-based SAR systems with receive-only apertures such as HRWS (high resolution wide swath) SAR systems, possibly for radiators in C band SAR systems such as Sentinel 1 and for radiators in X band systems similar to TerraSAR/Tandem-X.

The invention has the advantage that, in contrast to conventional slotted waveguides, the propagation modes are no longer dispersive, but correspond to those in coaxial lines, i.e., TEM modes. The bandwidth can increase hereby. Moreover, the cross sections of the waveguides can be considerably reduced in size, since no lower cut-off frequency exists with TEM modes. Another advantage is that the resonance is independent of the cross section, whereby manufacturing tolerances no longer have a negative impact on the electrical performance. Furthermore, it is advantageous that with the invention the coupling can take place via a direct coaxial junction, which mechanically is very easy to realize, for example, by commercially available SMA installation bushings. Finally, compared to microstrip patch antennas, much greater radiator lengths can be realized with the invention, for example, up to approx. 80 cm in the X band.

According to one embodiment, the invention now relates to a waveguide radiator, in particular for SAR systems, comprising:

A slotted waveguide with a plurality of slots inserted in the waveguide; and

An additional inner conductor installed inside the waveguide, which inner conductor is shaped in a polarization-dependent manner such that all of the slots of the waveguide can be excited with identical phase and amplitude.

In a further embodiment, the slotted waveguide can be partially filled with a dielectric material on which the additional inner conductor is arranged. This has the advantage that an embodiment of this type renders possible a simple production and nevertheless a sturdy arrangement of the additional inner conductor in the waveguide.

The additional inner conductor can also have a coiled structure in one embodiment. This has the advantage that an adjustment of the propagation velocity in the longitudinal direction can be hereby undertaken and the phase progression on the inner conductor can thereby be adapted to the spacing of the slots, so that it is ensured through the coiled form that all of the slots of the slotted waveguide radiator are excited with identical phase.

Furthermore, the additional inner conductor can also be asymmetrical. This provides an advantage in particular when the feed of the waveguide is offset from the center in the longitudinal direction. An arbitrary phase ratio can thereby be adjusted between the left and right half of the waveguide, in particular a radiation of a wave with identical phase from all of the slots of the waveguide can be achieved.

The slotted waveguide can also have transversal slots, whereby the waveguide is embodied in order to radiate horizontally polarized waves. In combination with the inner conductor, a high efficiency and a high purity of the horizontally polarized waves can hereby be ensured.

Furthermore, according to one embodiment of the present invention, a feed of the waveguide can be arranged asymmetrically in the longitudinal extension direction. This provides the advantage that a feed of this type of the waveguide defines two halves of the same, so that a signal conducted on the additional inner conductor can have a phase differing from one another in the two waveguide halves. This renders possible an adjustment of the radiation behavior of waves traveling on the additional inner conductor from the feed in opposite directions.

It is also favorable if the feed of the waveguide is arranged in the same such that through the feed two waveguide sections are defined in which during operation of the waveguide a wave propagates with a phase difference of approx. 180° based on the center of the waveguide. This makes it possible for all of the slots to be excited with the same phase with the center frequency, whereby the high purity of the radiation behavior of a waveguide radiator of this type can be achieved.

The additional inner conductor can also have a coiled shape in a further embodiment. The length and number of the coil sections are thereby adapted to the spacing of the slots such that there is always a fixed number of coil sections between consecutive slots. In particular such that the coiled form in a coil section has a rotation angle $phi_h$ and a radius $x_h$, where $$x_h = \frac{mea_{w_k}^2 + mea_{l_h}^2}{4 \cdot mea_{w_h}}$$

$$phi_h = 2 \cdot \arctan\left(\frac{mea_{w_h}}{2 \cdot mea_{l_h}}\right)$$

holds true, where $mea_{wh}$ defines the transversal characteristic of a coil section and $mea_{lh}$ the length of a coil section of the additional inner conductor. This has the further advantage that through the suitable choice of the coil thickness and number of coil sections of the additional inner conductor between successive slots it can be ensured that the desired excitation of the individual slots takes place in the predetermined phase ratio to one another.

Furthermore, in a further embodiment the additional inner conductor can have a plurality of identical coil sections starting from a feed point arranged in a central area of the additional inner conductor in the direction of the waveguide ends. This additionally supports the excitation with identical phase of the individual slots of the waveguide.

According to a further embodiment of the present invention, a straight segment of the inner conductor can be arranged between the feed point and a first coil section of the inner conductor. This provides the advantage that though the provision of a short straight segment of this type between the feed point and the first coil section of the inner conductor, a finely adjustable coordination of the phase response of an oscillation to this section of the additional inner conductor is possible, without a correction or adjustment of the geometry of the coil section having to be carried out.

In a further embodiment of the present invention, the inner conductor can have a straight inner conductor segment as an open line termination in the area of one end of the waveguide. The electric length of this line termination is thereby dimensioned to a quarter of the line wavelength. This makes it possible for the current step-ups of the forming standing wave to be located exactly under the slots, and thus an optimal excitation of the slots for the radiation to be guaranteed. This can be realized well and simply through the open line termination in the form of the straight segment.

According to a further embodiment of the present invention, the slotted waveguide can have slots arranged longitudinally, whereby the waveguide is embodied to radiate vertically polarized waves. An embodiment of the invention of this type again also provides the advantage that a vertically polarized wave can be generated and radiated by the waveguide radiator in a highly efficient manner and with a high degree of purity.

It is also favorable if the additional inner conductor has a feed point that is arranged centrally in the slotted waveguide and symmetrically to the slots. With longitudinally arranged slots in the waveguide, this renders possible a phase-synchronous excitation so that the individual slots radiate a wave with identical phase.

In a further embodiment the additional inner conductor can have a coiled form with a plurality of coil sections. An adjustment of the wavelength of a wave guided on the additional inner conductor to the spacing of the individual slots can advantageously be carried out hereby. In addition, it can be achieved hereby that a radiation with identical phase of all slots is ensured.

A coil section can also have a straight section and a curved section. In particular the curved section can cause a transversal guidance of a wave traveling on the additional inner conductor in the area of the slots, so that an optimal radiation of an electromagnetic wave through the slot is ensured through the current flow transversal to the slot length.

In particular the curved section can have three curvature sections of which a first and third curvature section has respectively a first or third radius of curvature $x_1$ and a first or third angle of curvature $phi_{1\nu}$ according to $$x_1 = \frac{\left(\frac{mea_{w_\nu}}{2}\right)^2 + mea_{d_\nu}^2}{2 \cdot mea_{w_\nu}}$$

$$phi1_\nu = 2 \cdot \arctan\left(\frac{mea_{w_\nu}}{2 \cdot mea_{d_\nu}}\right)$$

and a second curvature section arranged between the first and third curvature section comprising two partial curvature sections with respectively one second radius of curvature $x_2$ and a second angle of curvature $phi_{2\nu}$ according to $$x_2 = \frac{mea_{w_\nu}^2 + mea_{d_\nu}^2}{4 \cdot mea_{w_\nu}}$$

$$phi2_\nu = 2 \cdot \arctan\left(\frac{mea_{w_\nu}}{mea_{d_\nu}}\right)$$

where $mea_{w\nu}$ defines the transversal characteristic of the second curvature section and $mea_{d\nu}$ defines the length of the three curvature sections of the additional inner conductor. With this geometry a transversal characteristic of the first and second curvature section results, which is exactly half as big as the transversal characteristic of the second curvature section. Through a geometry of this type in the area of the curved section of the additional inner conductor, this runs transversally in the central area of the slot lying above it. The transversal currents generated hereby excite the slot to radiate a vertically polarized wave.

Furthermore, the inner conductor in the area of one end of the waveguide can have an open line termination, which has to a part of a curved section with a first curvature section, followed by a straight conductor segment and further followed by a second curvature section and a further straight inner conductor segment. A type of "half" coil section is hereby formed in the area of one end of the waveguide, so that a transversal wave guidance and thus a transversal deflection of the wave field is also made possible at the end of the waveguide, so that the outermost slot is excited to radiate in the same manner as the two slots located in front of it. The open line termination is thereby dimensioned in its length such that the standing wave forming on the inner conductor has current step-ups on the transversally guided line sections centrally below the slots located above. An optimal radiation behavior of all of the slots is hereby ensured.

According to another embodiment of the present invention, a phased array radiator has the following features:

A first waveguide radiator that is embodied to emit horizontally polarized waves during an operation; and A second waveguide radiator that is embodied to emit vertically polarized waves during an operation.

Furthermore, the first and second waveguide radiators can be aligned longitudinally with respect to one another and have an identical length. A TEM wave can be emitted through the two waveguide radiators in a spatially small range hereby so that at a greater distance from the openings of the waveguide radiators it is no longer directly discernible that the TEM wave was generated by the two waveguide radiators.

The first waveguide radiator can also be arranged horizontally and vertically offset with respect to the second waveguide radiator. Advantageously application parameters for the phased array radiator can be varied or adjusted hereby, which result from the wavelength range used for which the phased array radiator is provided.

In another embodiment of the present invention an electrically conductive material can be arranged in the area produced by the offset. This provides the advantage that with an offset of the two waveguide radiators with respect to one another, no stray radiation can occur in the area occurring through the offset.

According to another embodiment of the invention, a synthetic aperture (SAR) radar device, in particular a high-resolution synthetic aperture radar device, is provided, which comprises a waveguide radiator according to the invention or a phased array radiator. The SAR device can be in particular an HRWS system. To this end the phased array radiator can be embodied in particular as a radiator for a C band SAR system such as Sentinel 1 and as a radiator for an X band system similar to TerraSAR/Tandem-X.

Further advantages and application possibilities of the present invention are shown by the following description in conjunction with the exemplary embodiments shown in the drawings.

In the specification, in the claims, in the abstract and in the drawings the terms and assigned reference numbers are used that are used in the list of reference numbers attached at the back.

Figure 2:
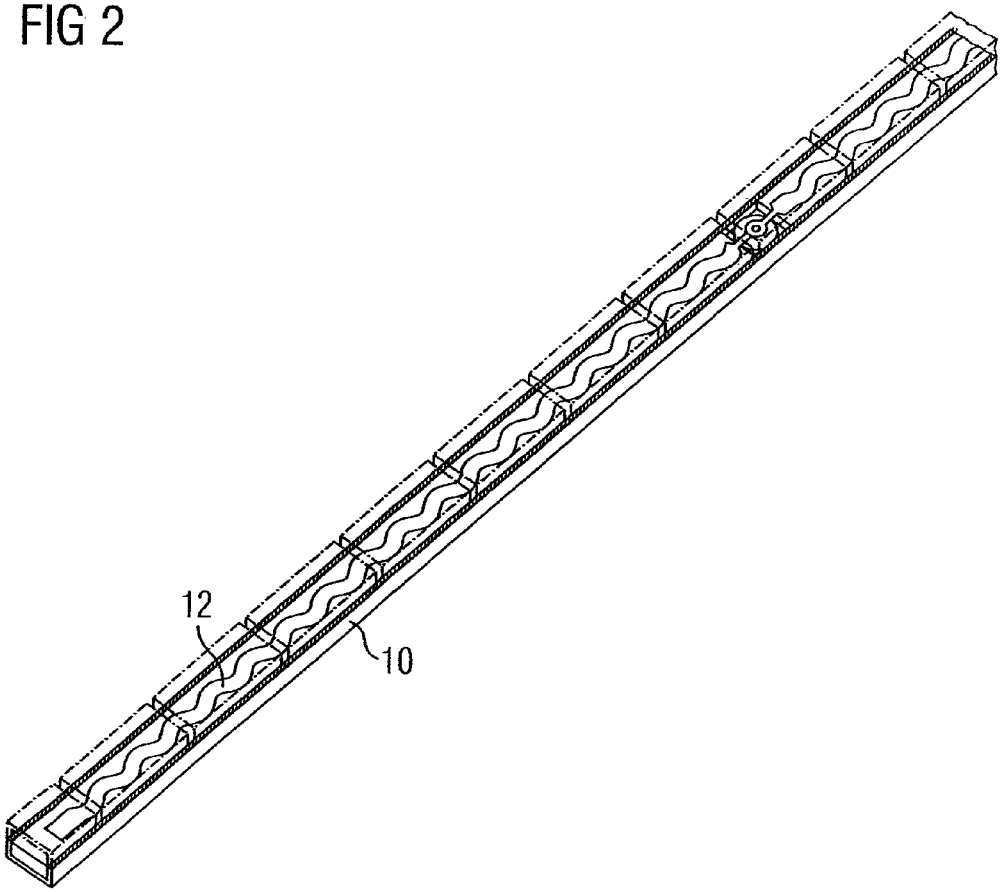
Figure 3:
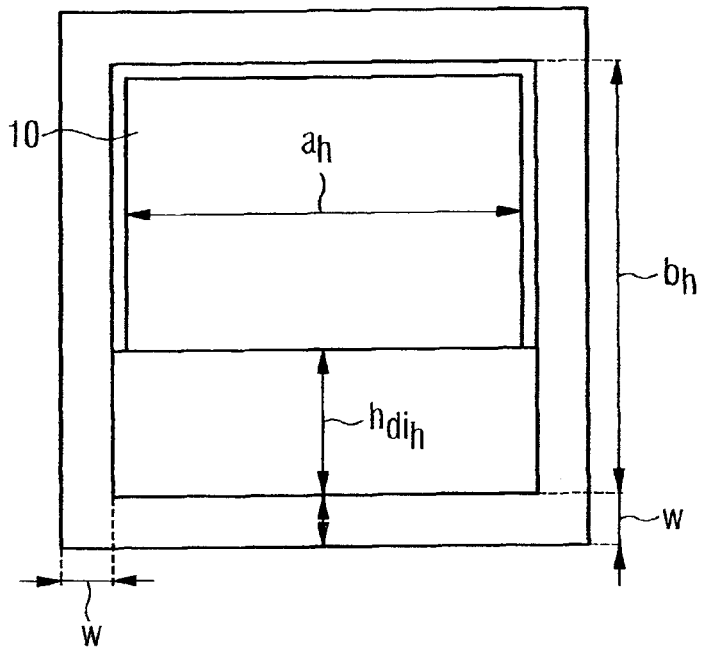
Figure 4:
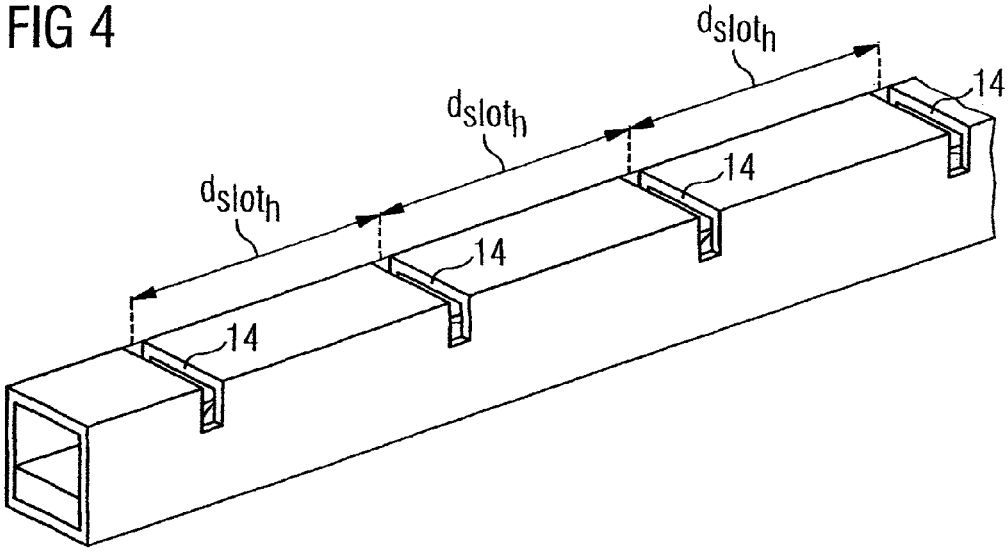
Figure 5:
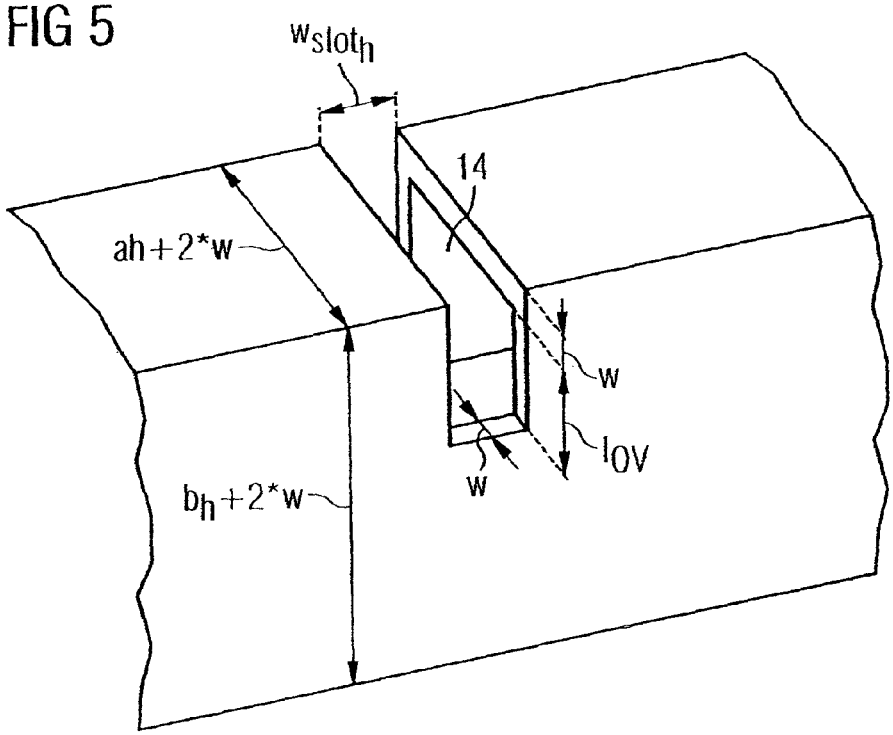
Figure 6:
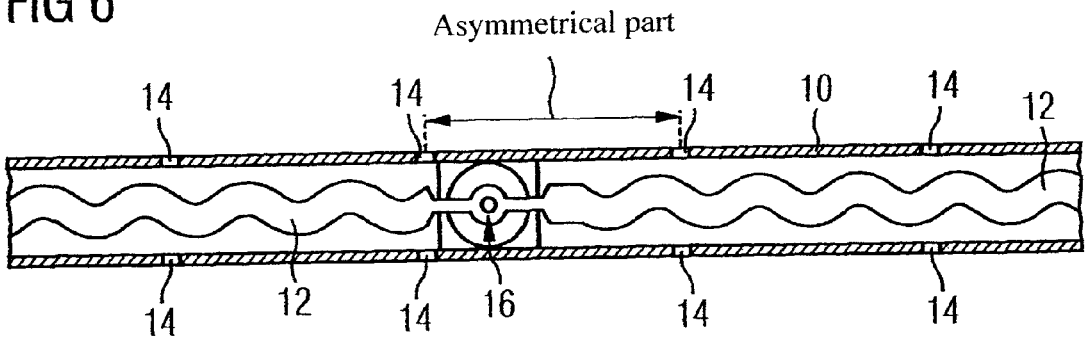
Figure 7:
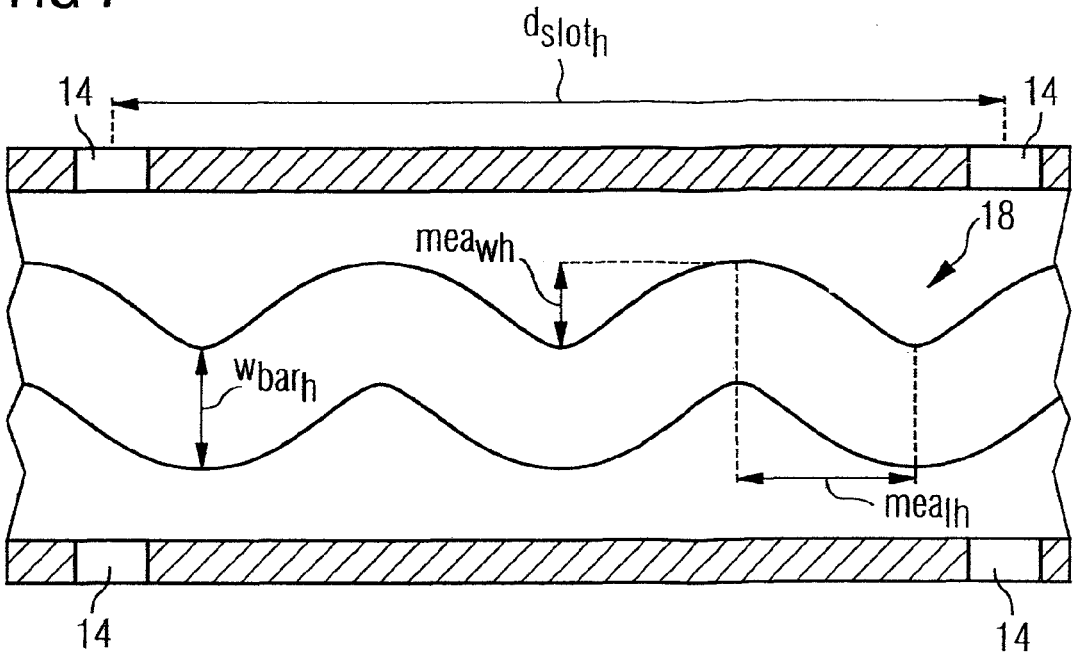
Figure 8:
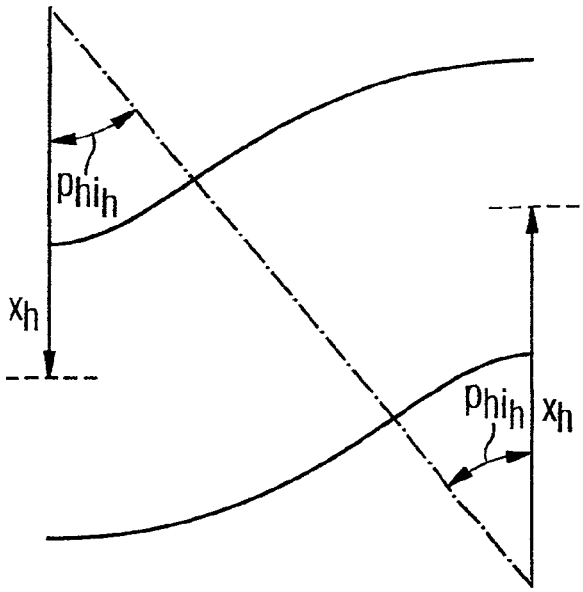
Figure 9:
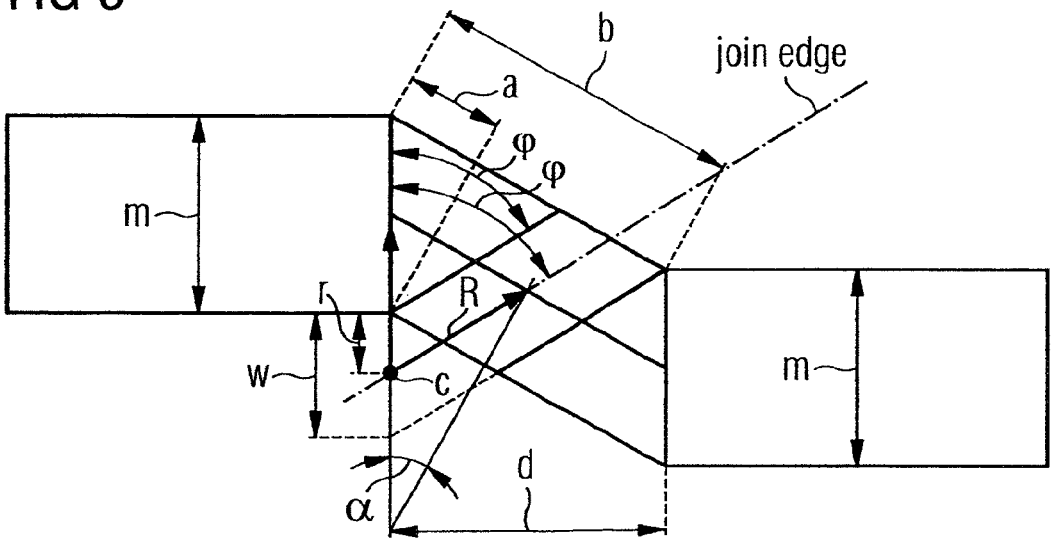
Figure 10:
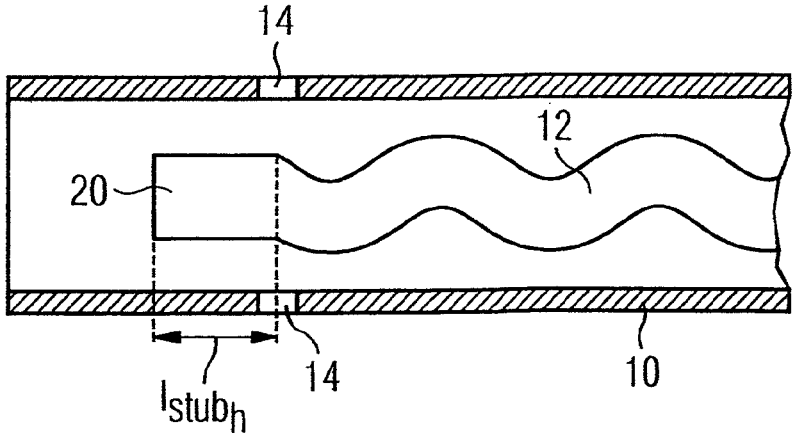
Figure 11:
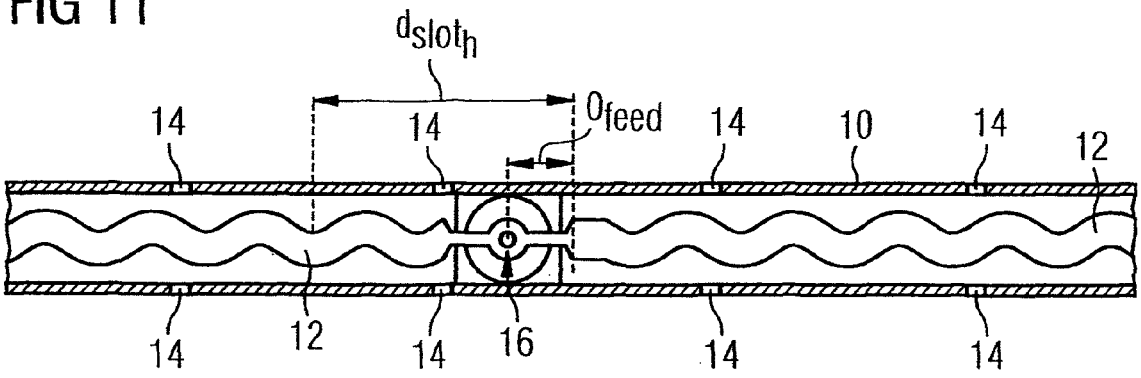
Figure 12:
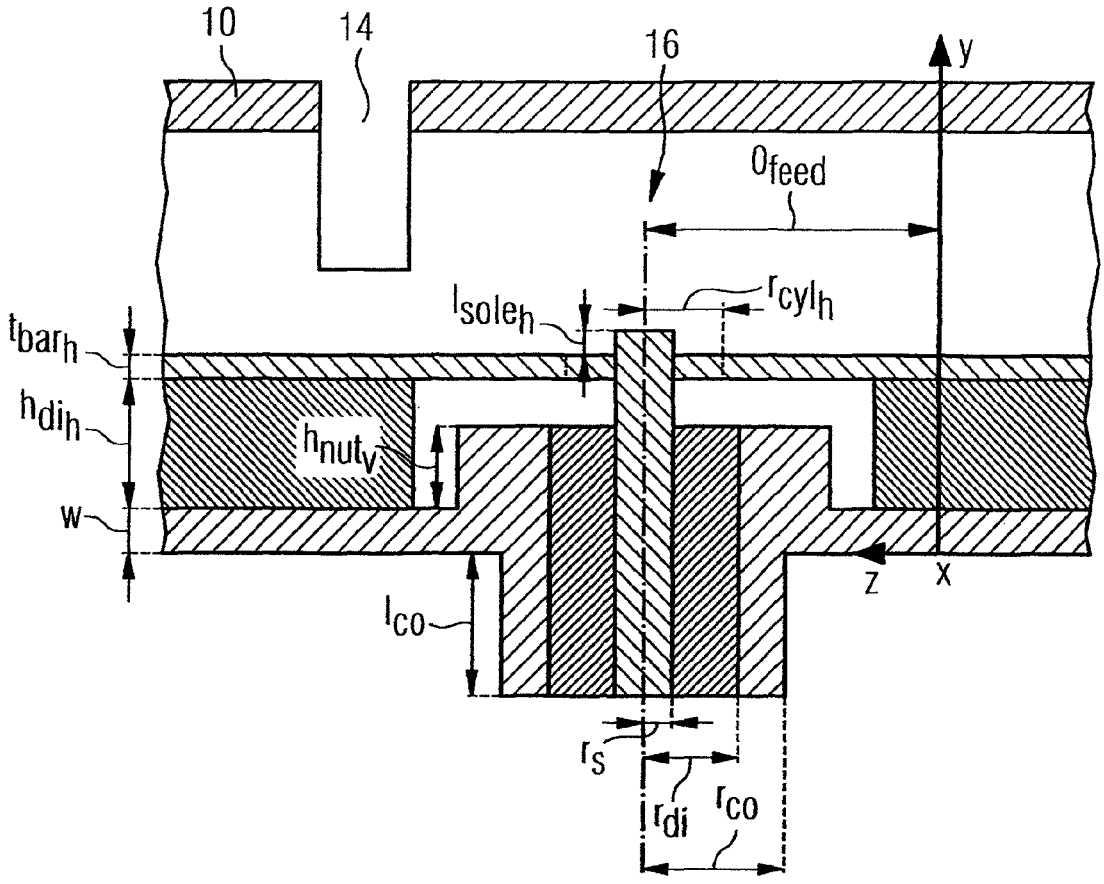
Figure 13:
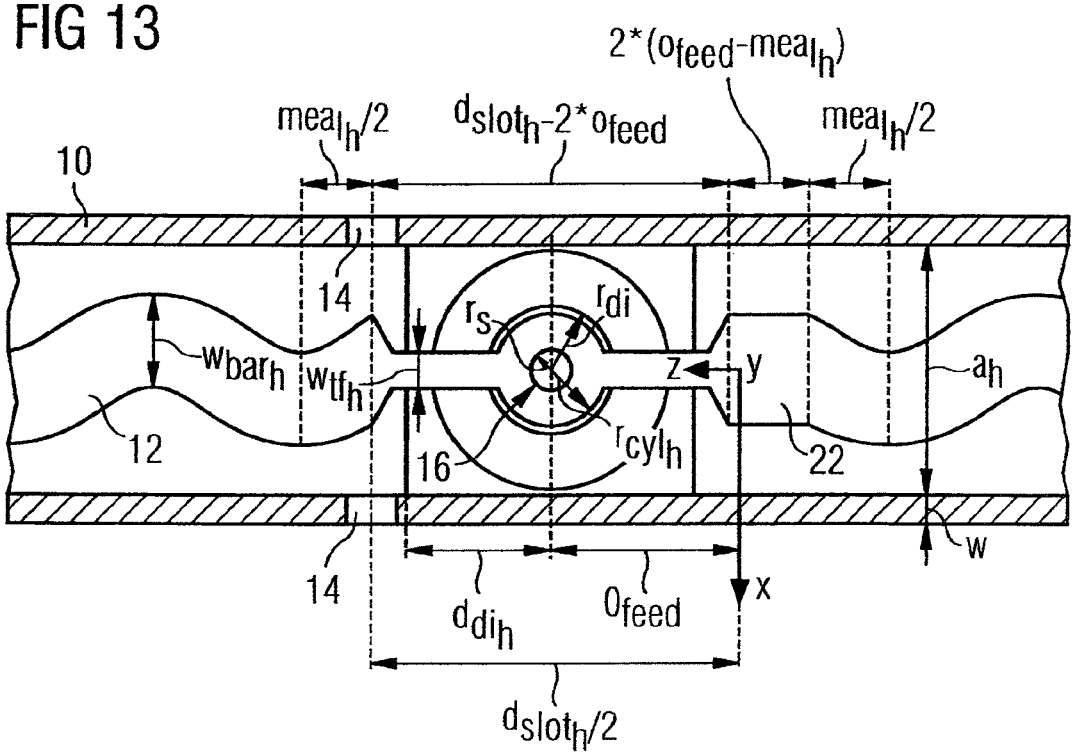
Figure 14:
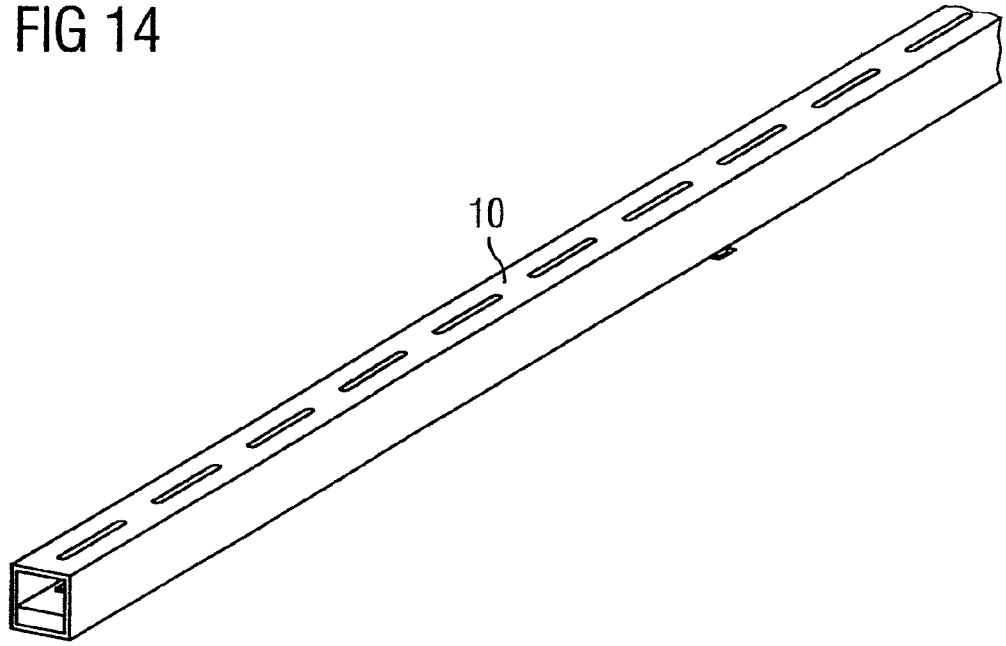
Figure 15:
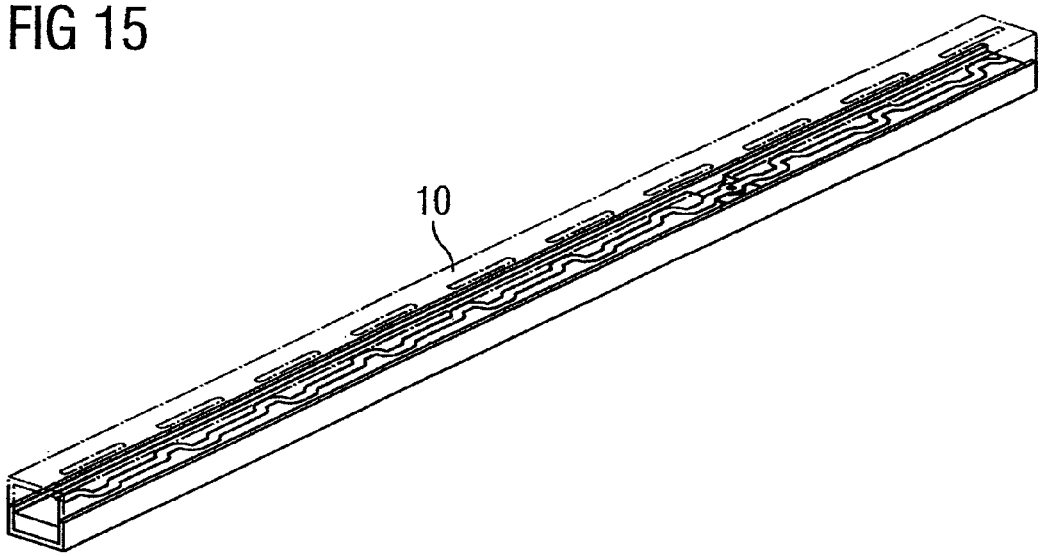
Figure 16:
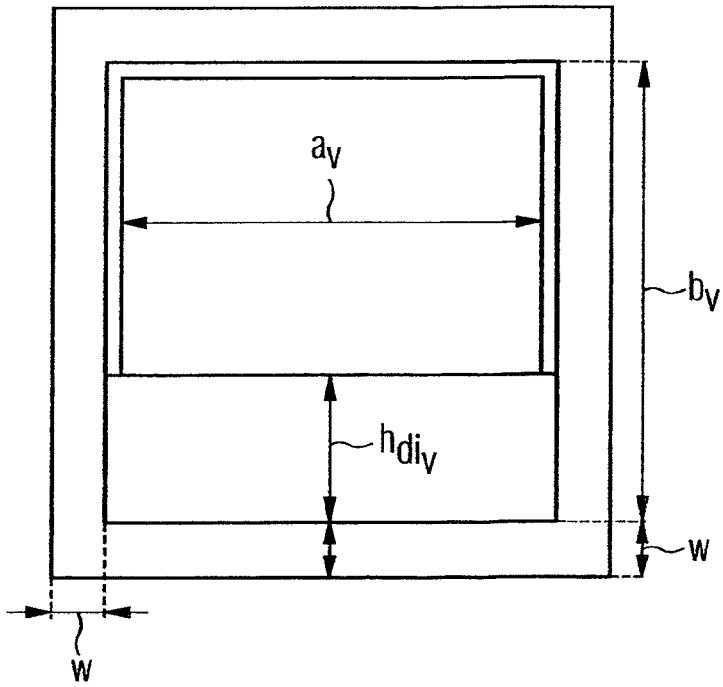
Figure 17:
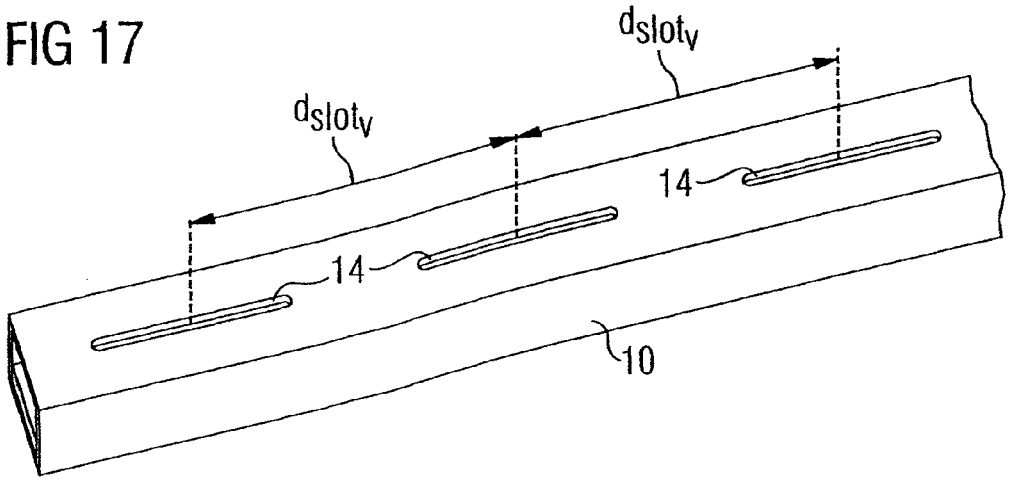
Figure 18:
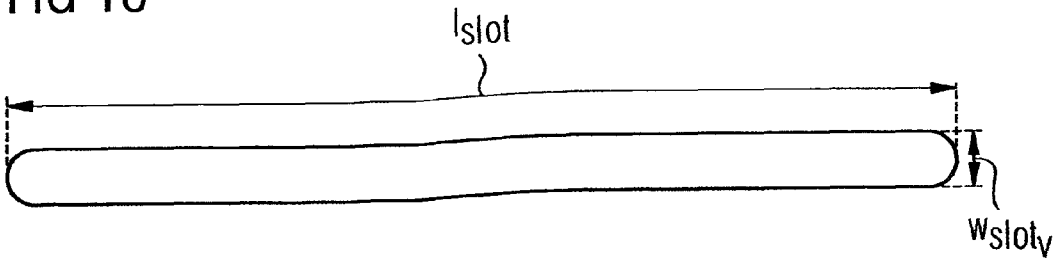
Figure 19:
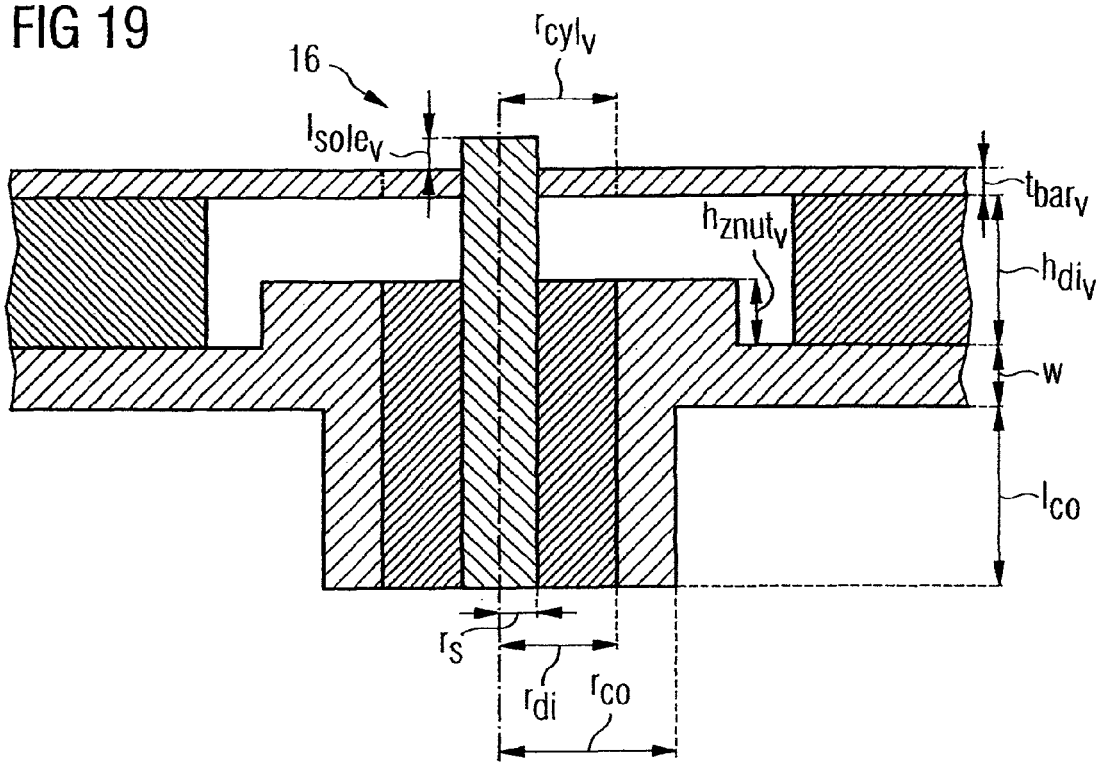
Figure 20:
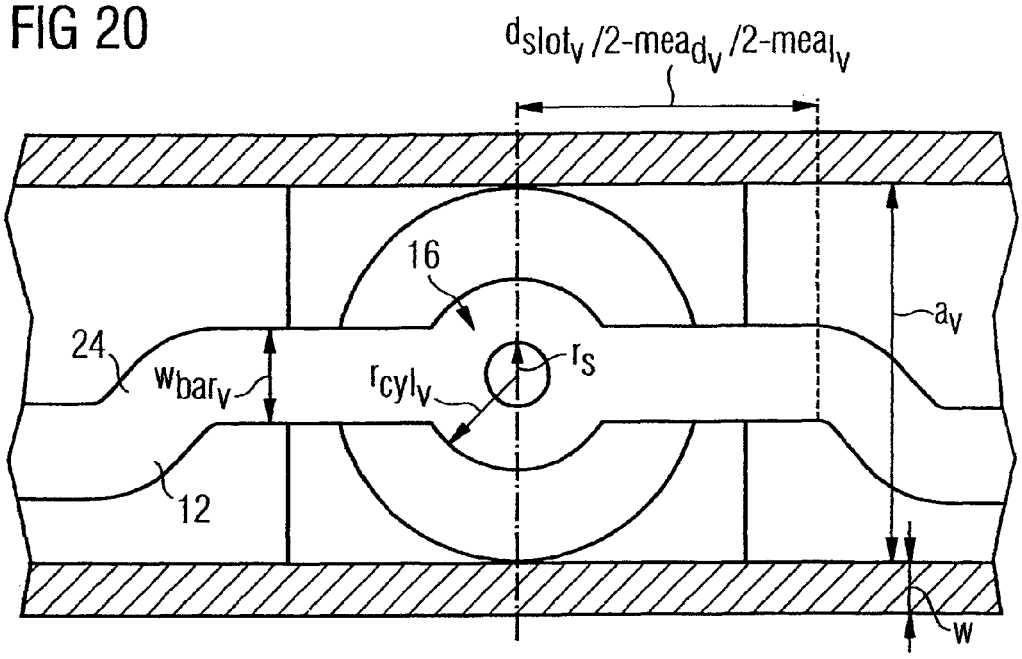
Figure 21:
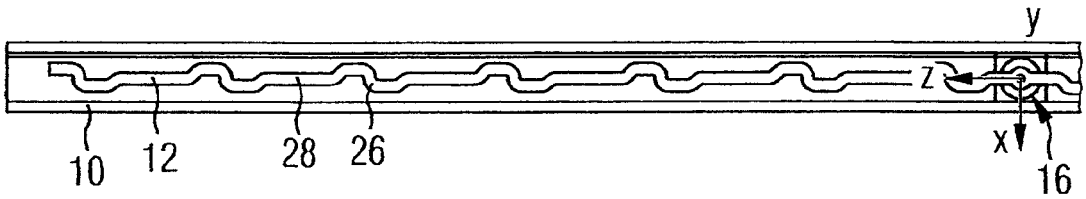
Figure 22:
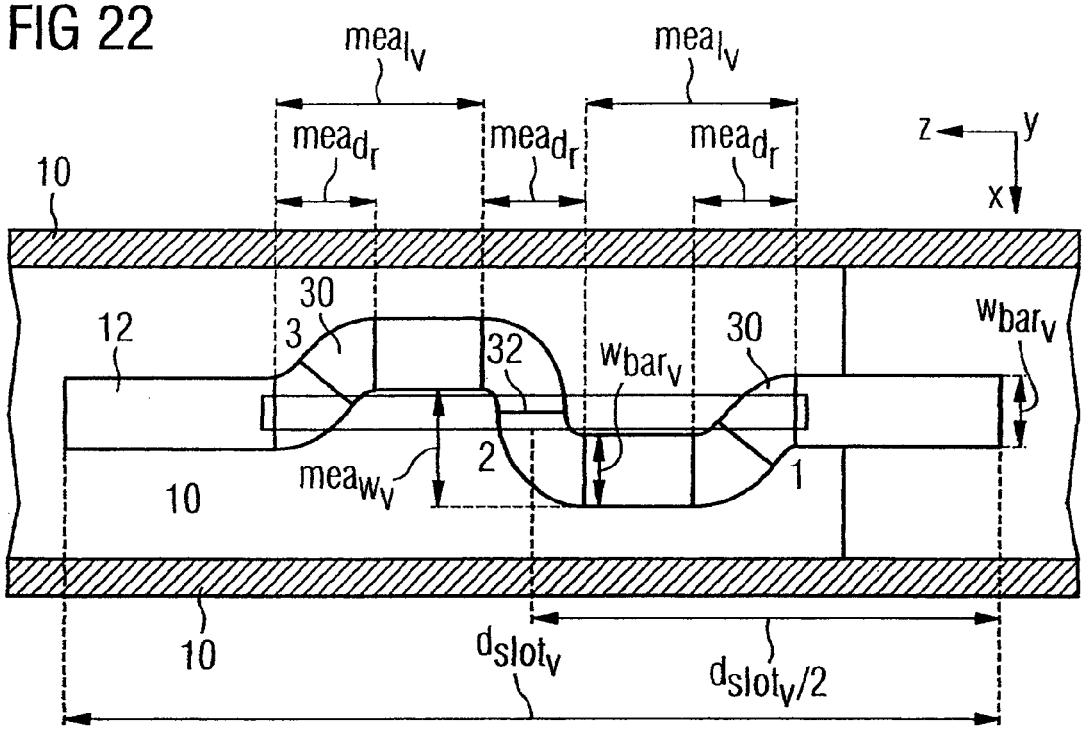
Figure 23:
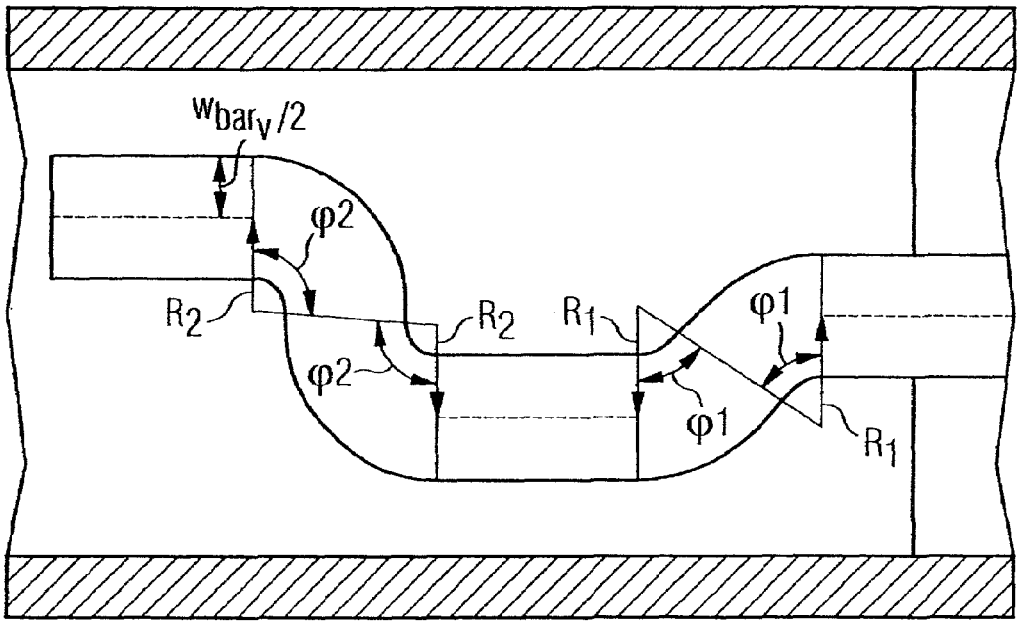
Figure 24:
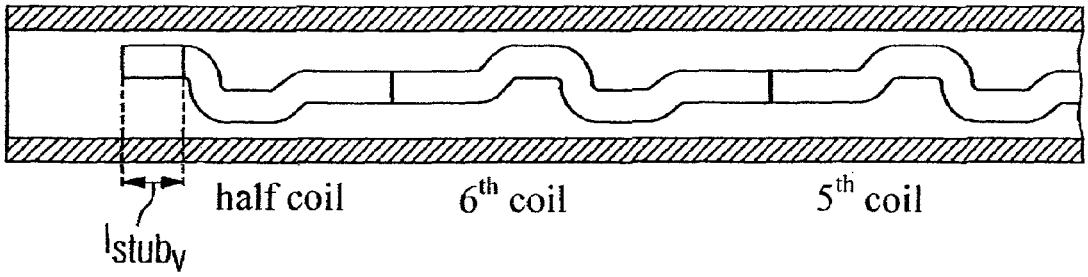
Figure 25:
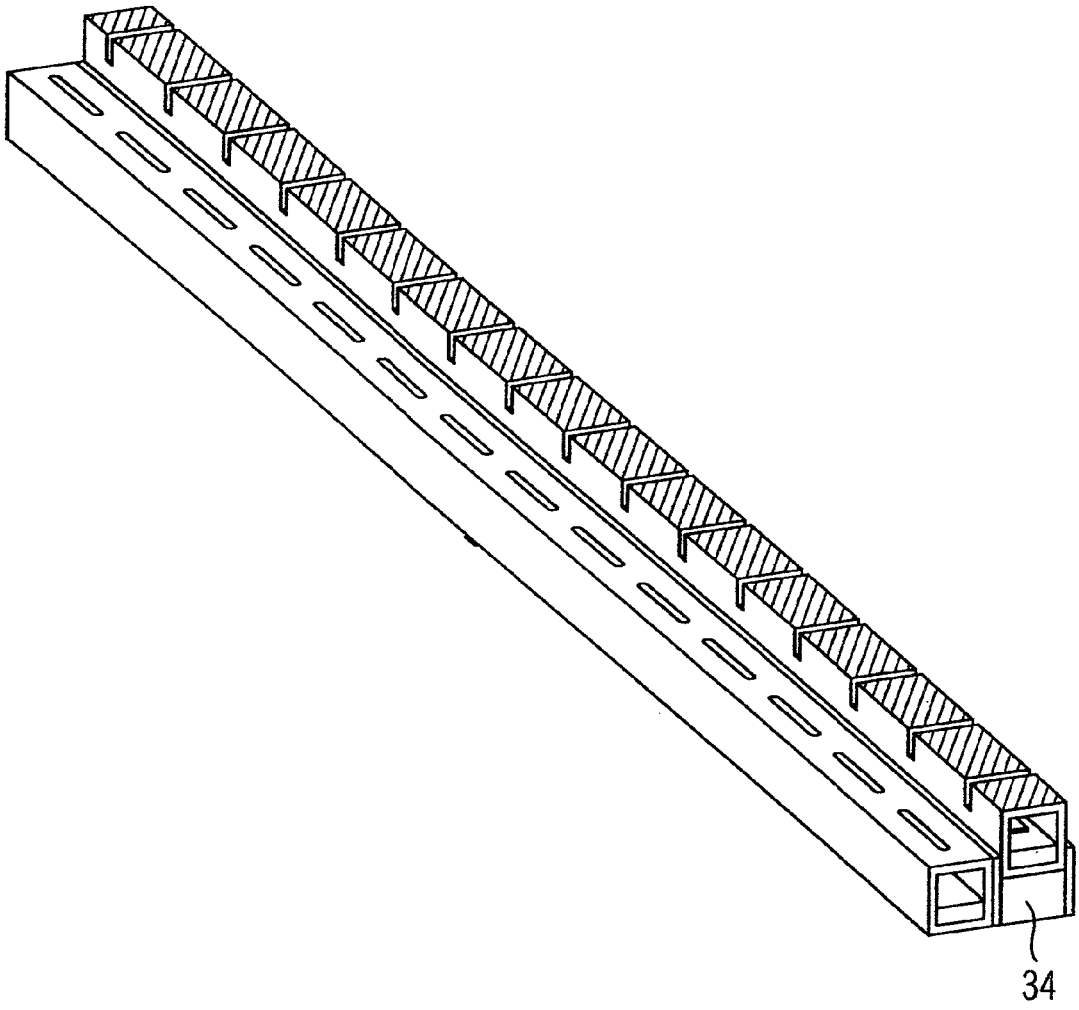
Figure 26:
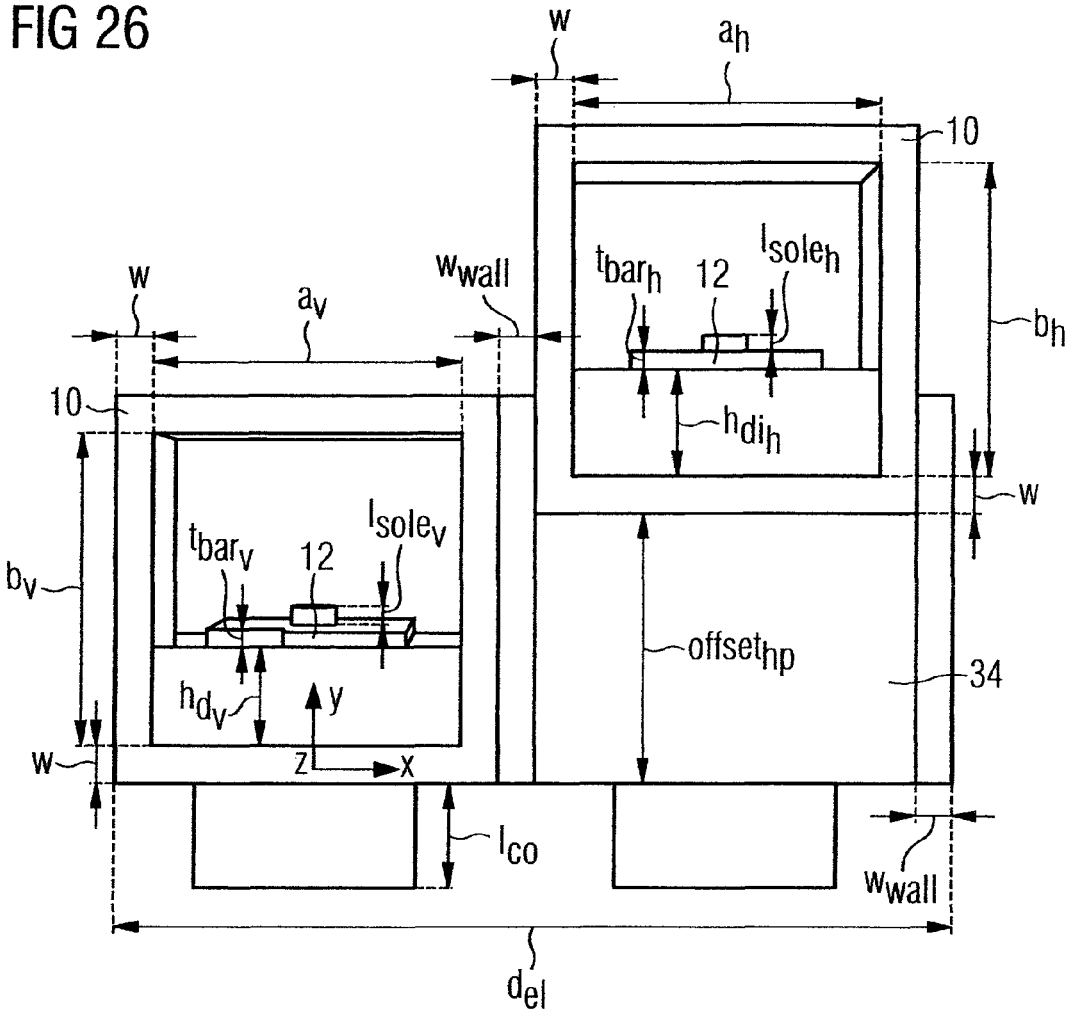
Figure 27:
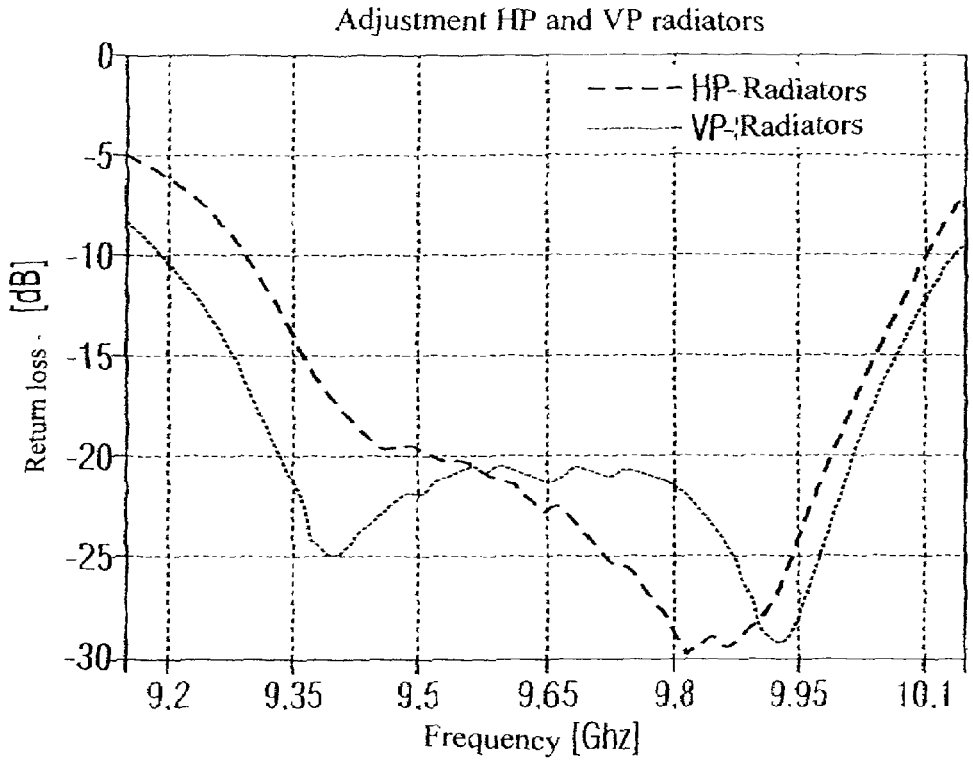
Figure 28:
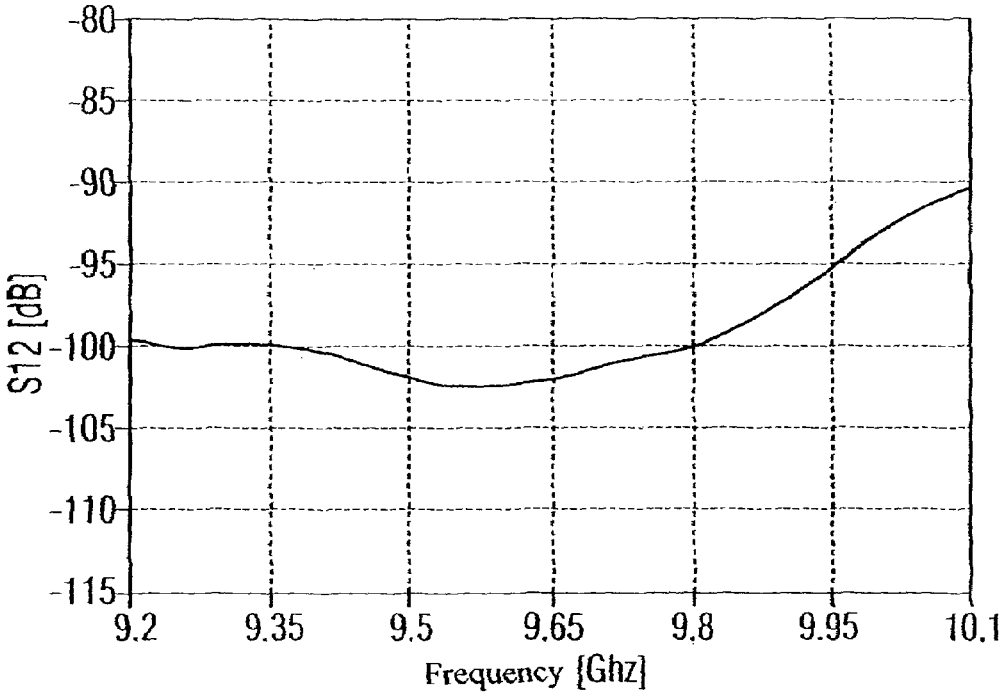
Figure 29:
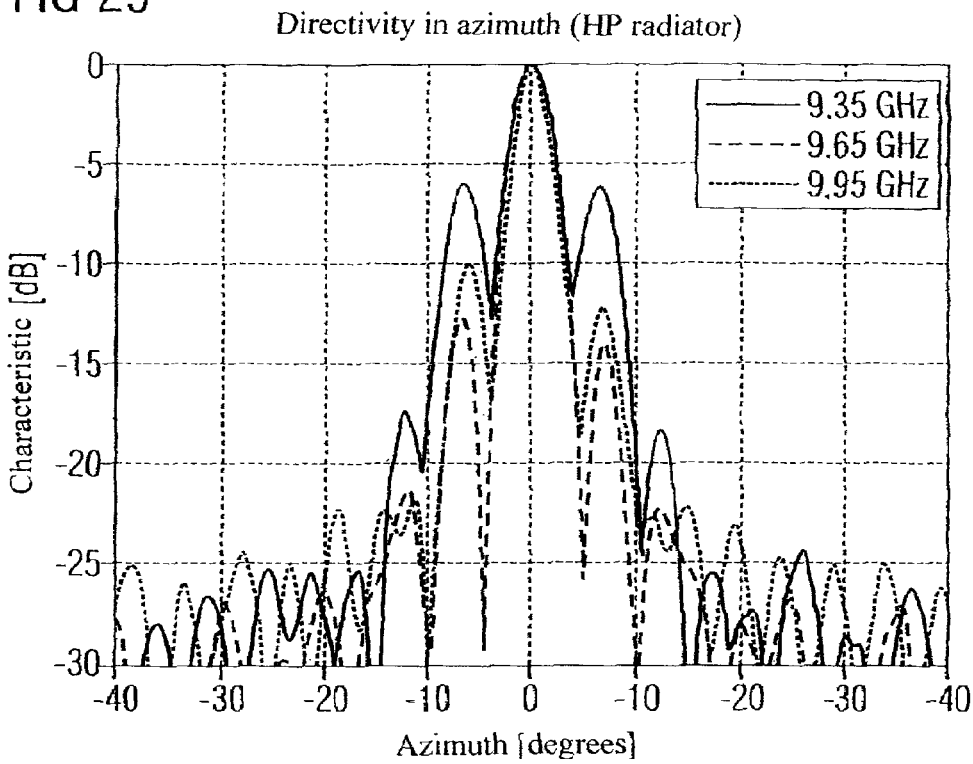
Figure 30:
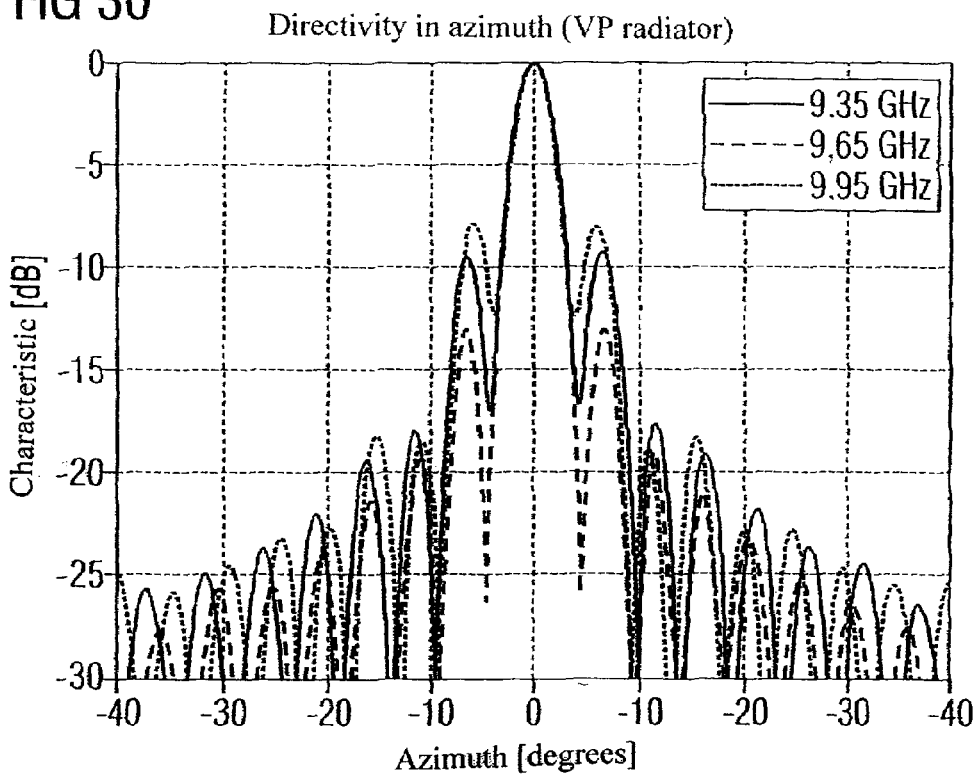

The drawings show:

FIG. 1 A view of a horizontally polarizing (HP) waveguide according to an exemplary embodiment of the present invention;

FIG. 2 An internal configuration of the HP waveguide shown in FIG. 1;

FIG. 3 A cross section of an HP waveguide according to an exemplary embodiment of the present invention;

FIG. 4 A transversal slot distribution on an HP waveguide;

FIG. 5 An overview of the slot parameters on an HP waveguide;

FIG. 6 Asymmetries between the center and the first slot in each direction;

FIG. 7 A representation of the geometric parameters of the HP inner conductor design;

FIG. 8 A representation of a coil section of the HP inner conductor;

FIG. 9 A representation of the geometry of the coil line according to an exemplary embodiment of the present invention;

FIG. 10 An open line termination at the end of an inner conductor HP waveguide according to an exemplary embodiment of the present invention;

FIG. 11 A representation of the offset of an HP waveguide feed;

FIG. 12 A representation of the cross section of a waveguide feed;

FIG. 13 A representation of the plan view of the waveguide feed;

FIG. 14 A view of a vertically polarizing (VP) waveguide;

FIG. 15 A representation of the internal structure of a VP waveguide;

FIG. 16 A cross-sectional representation through a VP waveguide;

FIG. 17 A representation of the slot distribution along a VP waveguide;

FIG. 18 An overview of the slot parameters of a VP waveguide;

FIG. 19 A side view of the geometry of a waveguide feed;

FIG. 20 A plan view representation of the waveguide feed in the form of a coaxial feed;

FIG. 21 A representation of a shape of an inner conductor in a VP waveguide;

FIG. 22 An overview of the geometric parameters of an inner conductor design;

FIG. 23 A representation of two first coil sections of an inner conductor VP waveguide;

FIG. 24 A representation of an open line termination at the end of a VP waveguide;

FIG. 25 A view of an HP VP waveguide as a phased array radiator;

FIG. 26 An overview of the geometric parameters of a dual polarized radiator;

FIG. 27 A graphic representation of the reflection damping in dB for a VP and an HP radiator;

FIG. 28 A graphic representation of a coupling behavior between VP and HP radiators in dB;

FIG. 29 A graphic representation of the directivity of an HP radiator in the azimuth far field; and FIG. 30 A graphic representation of the directivity of a VP radiator in the azimuth far field.

The same and/or functionally the same elements can be provided with the same reference numbers below. The absolute values and measurements given below are only exemplary values and do not represent a restriction of the invention to such dimensions.

The following statements describe the configuration of a dual polarized microwave antenna radiator called a TEM radiator. The field of application is the planar phased array antennas, such as are used in the synthetic aperture radar systems (SAR) in aviation or space flight as a radiating element. For these applications usually microstrip-patch or slotted waveguide antennas are used although they are associated with some disadvantages, which can be overcome with this new type of radiator.

The necessary properties of the radiators are high electrical efficiency (low ohmic losses), sufficiently high bandwidth and cross-polar suppression. For a flexible phased array design it is additionally desirable to have radiators that can be easily scaled in size.

The microstrip patch is a radiator that is relatively simple to produce, even if the electrical efficiency is limited by high ohmic losses, which are particularly marked for longer radiator lengths. Consequently the use of microstrip patches is limited to applications with short phase centers, which are necessary only for a high-resolution mode of operation (e.g., spotlight mode of operation).

The slotted waveguide antenna is a highly efficient radiator that was used in some space flight SAR missions (e.g., X-SAR, SRTM, TerraSAR-X). Dual polarization capacity is achieved through a parallel waveguide concept, in which two separate waveguides, with one for each linear polarization, are aligned next to one another. Due to the resonance behavior, the application of these radiators is limited to narrowband applications. In addition, its production is very expensive, since very high mechanical precision is necessary and the geometry of the radiator is very complex. Now that the trend in modern SAR systems is towards higher bandwidths and at the same time lower deployment costs, the slotted waveguide is becoming less and less attractive for future SAR missions. Instead, alternative radiator designs are required, which combine the electrical efficiency of the slotted waveguide (high efficiency and polarization purity) together with low production costs. The TEM radiator has been developed for this purpose.

The TEM radiator is an improvement of conventional slotted waveguide antennas. This improvement is achieved by adding an inner conductor (inner conductor, barline) into the waveguide, which is specially adapted for each polarization. The inner conductor changes the basic electrical behavior of the waveguide. The name "TEM radiator" comes from the electric modes that propagate in this waveguide. TEM stands for "transversal electromagnetic." One main property of these modes is that they are not dispersive. This point is where the TEM radiator differs from the conventional slotted waveguides, which are based on TE modes that exhibit dispersive behavior, and the resonance of which is dependent to a large extent on the cross section of the waveguide. Depending on the cut-off frequency of the waveguide, the dispersion restricts the achievable bandwidth considerably.

The inner conductors in the TEM radiator can easily be produced at very low cost through an etching or a milling process. The waveguides can be produced from aluminum with an attractive property such that several radiators are grouped together in one block (tile concept).

The detailed geometric configuration of the TEM radiators is described below, beginning with a separate description for each polarization (H/V pol.). Then the configuration of the complete dual polarized radiator is described. Finally, the measured electrical efficiency is shown. The design is designed by way of example for a radiator in the X band (medium frequency: 9.65 GHz) and a radiator length of 400 mm. The radiator can easily be scaled for another medium frequency (e.g., C band) or to other radiator lengths by changing the number of slots.

Geometric Description

In this section a summary is given of all of the parameters and design methods of HP and VP waveguides.

Horizontal Polarization (HP)

FIG. 1 shows a general perspective of the horizontally polarized waveguide 10.

The technology used in the design of an HP radiator follows the same principles as with the VP radiator. The external form of the waveguide 10 corresponds to that of the HP radiator in the Terra-SAR X. But in order to excite the slots, a coiled inner conductor 12 placed on a dielectric layer is inserted along the waveguide 10 (see FIG. 2).

The following sections give a more extensive explanation of the HP waveguide design.

Cross Section

The basis of the HP radiator is a conventional rectangular waveguide 10 with extent $a_h$ (wide wall width) and $b_h$ (narrow wall width) as is shown in FIG. 3. All of the walls have a thickness w and the length of the waveguide 10 is defined by 1.

Moreover the waveguide 10 is filled along its length with Eccostock Lok, a dielectric material where $\in_r$ is equal to 1.7. The height of the dielectric is parameterized by $h_{dih}$.

Slot Design

In order to convert the rectangular waveguide 10 into a radiator, several transverse slots 14 have been cut in the upper wall along the length of the waveguide 10 (see FIG. 4). A total of 16 slots 14 are placed symmetrically to the center of the waveguide 10, eight on each half thereof. The spacing $d_{sloth}$ between the slots 14 is one line wavelength $\lambda_g$.

The geometry of the transversal slots 14 is shown in FIG. 5. As is shown, the slot width is defined by $w_{sloth}$ and the slot 14 is cut in the sidewall of the waveguide 10 in a length $l_{ov}$.

Inner Conductor Design

Since the feed point 16 is not placed centrally in the waveguide 10, the inner conductor 12 is not symmetrical in the HP waveguide either. However, the asymmetries between the center of the waveguide 10 and the first slot 14 are placed respectively in each direction (see FIG. 6). That means in order to simplify the design we take into account that the inner conductor 12 is symmetrical along both halves of the waveguide 10 from the first slot to the end of the inner conductor 12.

The design of the inner conductor 12 between the center slots is described below, where the feed 16 of the waveguide 10 is explained.

FIG. 7 shows a more extensive image of the coiled form and the parameters used.

In order to design the coil it is necessary to select a suitable twist angle and the center of the rotation axis. FIG. 8 shows the coil section, which is repeated along the entire waveguide, more precisely.

Before we continue with the conductor design, it is interesting to see the terms in detail that were used for calculating the radius and the angle. FIG. 9 shows a general case of two inner conductor sections with width m, which have to be connected by a coil section. The necessary parameters for the construction of the coil section are the center c or the radius R and the angle $\phi$ about which it is to be rotated.

According to the previous geometry, two triangular legs of the same length (the side lengths correspond to m, m and 2*a) are defined in both straight line sections. The "connecting edge" (also called the "join edge" where the two coil sections are brought together) is defined by drawing the center parallel line through the parallelogram that is formed between two triangles. This edge and the extension of the narrow side of the wave section define the rotational radius.

Taking this geometry into account, a few statements can be made:

$$\begin{aligned} \varphi &= 2a \\ a &= m \cdot \sin\alpha \\ b &= \sqrt{w^2 + d^2} \\ \alpha &= \arctan\frac{w}{d} \\ o &= \frac{b - 2a}{2} \end{aligned} \tag{2.1}$$

Therefore $\phi$ can easily be calculated by equation (2.2).

$$\varphi = 2\alpha = 2 \cdot \arctan\frac{w}{4} \tag{2.2}$$

To obtain R, the principle of intersecting lines can be applied for the two identical triangular legs from FIG. 9.

$$\frac{2a}{m} = \frac{b}{m + 2r} \tag{2.3}$$

If the value of r is calculated and inserted into (2.1), the following term is obtained:

$$\begin{aligned} r &= \frac{mb}{4a} - \frac{m}{2} \\ &= \frac{b}{4 \cdot \sin\alpha} - \frac{m}{2} \\ &= \frac{\sqrt{w^2 + d^2}}{4 \cdot \sin(\arctan w/d)} - \frac{m}{2} \end{aligned} \tag{2.4}$$

-continued $$r = \frac{\sqrt{w^2 + d^2}}{4 \cdot \frac{w/d}{\sqrt{1 + \frac{w^2}{d^2}}}} - \frac{m}{2} = \frac{w^2 + d^2}{4 \cdot w} - \frac{m}{2}$$

The following results from this:

$$R = r + \frac{m}{2} = \frac{w^2 + d^2}{4 \cdot w} \tag{2.5}$$

Following the geometry explanation in the previous section, in particular equations (1.2) and (2.5), the rotation angle $phi_h$ and the radius $x_h$ can be defined as follows:

$$x_h = \frac{mea_{w_h}^2 + mea_{l_h}^2}{4 \cdot mea_{w_h}} \tag{2.6}$$

$$phi_h = 2 \cdot \arctan\left(\frac{mea_{w_h}}{2 \cdot mea_{l_h}}\right)$$

The coil is repeated symmetrically along the waveguide 10 starting from the first slot 14. The inner conductor 12 is delimited on both sides with an open line termination 20 of a length $l_{stubh}$, as is shown in FIG. 10.

Waveguide Feed Design

In the HP waveguide 10 the feed 16 is not symmetrical in the longitudinal direction (z axis), although the slots 14 are placed symmetrically. It is displaced somewhat in order to insert a phase of 180° between the two halves of the waveguide 10. Thus all of the slots 14 are excited with the same phase at the medium frequency (see FIG. 11).

Apart from this offset, the feed design is exactly the same as in the case of the VP waveguide. A coaxial feed 16 (SMA socket) is inserted into the waveguide and the center conductor is connected to the inner conductor feed circuit by means of a bore for the inner coaxial conductor.

FIG. 12 shows a cross section of the coaxial feed 16 and the different design parameters are inserted.

As has been explained above, the asymmetries in the inner conductor 12 between the center of the waveguide 10 and the first slot 14 are placed in each direction. As can be seen in FIG. 13, the feed 16 has been laid through $o_{feed}$ along the +z axis. The coil section is repeated along the waveguide 10 up to the first slot 14 left and right of the feed point 16. Due to the feed offset, one and a half coils are added to the right branch of the inner conductor 12 (−z axis).

In order to bring the coaxial feed 16 and the inner conductor 12 together, a line with a width $w_{tfh}$ is added and is conically tapered to the width of the inner conductor $w_{barh}$ This transformation line is symmetrical with respect to the feeding coaxial point 16. Finally a straight section of the inner conductor 12 is added on the right branch in order to fill the space between the feed 16 and the coil.

Vertical Polarization VP

FIG. 14 shows a general view of a vertically polarized waveguide 10.

The inner structure with dielectric layer and inner conductor is shown in FIG. 15.

In this new design the waveguide 10 is partially filled with a dielectric and it radiates thanks to an inner conductor 12, which is placed along the waveguide length, which excites the longitudinal slots 14 that have been milled into the waveguide. A more extensive explanation of this VP waveguide is provided in the following sections.

Cross Section

The basis of the VP radiator is a conventional rectangular waveguide 10 with edges $a_v$ (wide wall width) and $b_v$ (narrow wall width) as is shown in FIG. 16. All of its walls have a thickness of w and the length of the waveguide 10 is defined by 1.

Moreover, the waveguide 10 is filled along its length with Eccostock SH1, a dielectric material where $\in_r$ equals 1.04. The height of the dielectric is parameterized by $h_{div}$.

Slot Design

In order to convert the rectangular waveguide 10 into a radiator, longitudinal slots 14 are cut into the upper wall and along the length of the waveguide 10 and symmetrically to the feed point 16, as shown in FIG. 17.

The electric length between slots 14 is a line wavelength $\lambda_g$, consequently the inner conductor parameters must be adjusted such that 360 degrees phase difference is obtained between consecutive slots.

The shape of the slot 14 is shown in FIG. 18. The slot ends are rounded, since this facilitates the milling process.

Waveguide Feed Design

The radiator is supplied by a coaxial feed 16 (SMA plug), which is placed centrally in the waveguide 10, as shown in FIG. 19. The radius of the coaxial shield, the coax dielectric and the coax inner conductor are $r_{co}$, $r_{di}$ and $r_s$ respectively. The feed 16 is inserted into the waveguide 10 with a height of the nut in the interior of the waveguide $h_{nutv}$. The coax inner conductor projects beyond the conductor at a height of $l_{solev}$.

FIG. 20 shows the plan view of the coaxial feed 16.

Inner Conductor Design

Instead of using a straight inner conductor 12, a more complex one was used in a design of the waveguide 10. FIG. 21 shows a plan view thereof. It comprises a coiled conductor, which is followed by a straight piece, which is periodically repeated along the length of the waveguide 10.

In the VP waveguide the feed point 16 is laid in the center of the waveguide 10. The inner conductor 12 is thus symmetrical with respect to the supply and is terminated with an open line termination, the length of which has to be adjusted.

FIG. 22 shows a more exact image of the coil form, and the parameters used for the design. The original Cartesian coordinates are placed precisely in the center of the waveguide length and show where the coaxial feed 16 is placed. The coil curves are designed in order to obtain a current transversal to the slot 14. This transversal current excites the slot to radiate. The inner conductor 12 has a width of $w_{barv}$ and a thickness of $t_{barv}$.

The most difficult part of the design of the inner conductor 12 is the definition of the curved sections. To this end a suitable radius and a suitable center must be calculated in order to bring both straight sections together. In the VP waveguide three curved sections are necessary. They are labeled in FIG. 22. The first (curvature) section (1) (also labeled by reference number 30) and the last (third curvature) section (3) (likewise labeled by reference number 30) have the same radius and angle. That means that only two different geometries are necessary, one for the first part of the coil and the other for the second part 32 (second curvature section) of the coil, as shown by FIG. 23.

Taking into account the geometries in FIG. 23 and in FIG. 9 and the equations (2.2) and (2.5), the radius and the angle for both coil sections can be calculated as follows.

$$x_1 = \frac{\left(\frac{mea_{w_v}}{2}\right)^2 + mea_{d_v}^2}{2 \cdot mea_{w_v}} \tag{2.7}$$

$$phi1_v = 2 \cdot \arctan\left(\frac{mea_{w_v}}{2 \cdot mea_{d_v}}\right)$$

$$x_2 = \frac{mea_{w_v}^2 + mea_{d_v}^2}{4 \cdot mea_{w_v}} \tag{2.8}$$

$$phi2_v = 2 \cdot \arctan\left(\frac{mea_{w_v}}{mea_{d_v}}\right)$$

The coil is repeated 6 times along each half of the waveguide 10. At the end of each side of the inner conductor 12, half of a coil is added and the complete inner conductor 12 is ended with an open line termination of the length $l_{stub_v}$, as shown in FIG. 24.

Final radiator configuration according to an exemplary embodiment of the present invention.

The radiators for both polarizations are designed and simulated separately, but now it is necessary to evaluate the complete radiator efficiency. In order to obtain the final dual polarized radiator, it is necessary to assemble both waveguides. This is dealt with in the next section.

FIG. 25 shows a perspective view of the complete radiator. It is discernible how the VP waveguide and the HP waveguide are aligned with the same length l longitudinally (i.e., in the z direction). Both waveguides are displaced by an offset in the x and y direction.

In the design of phased arrays, several dual-polarized radiators are lined up next to one another in the x and y direction. It can be necessary hereby to select the spacing of the radiators to be larger than their actual width. The gaps formed hereby should be suitably closed by electrically conductive material in order to thus suppress undesirable stray radiation. The spacing of two radiators in the y direction is labeled by $d_{el}$. The value of this spacing comes from the requirements of the SAR system and determines the tiltability of the main beam of the phased array. For a tiltability of ±20 degrees a spacing $d_{el}$ of 22 millimeters in the X band results hereby. Since the width of both waveguides 10 is less than $d_{el}$, the spacings between the waveguides 10 are filled with conductive material.

Moreover, the HP waveguide is displaced upwards in the y direction by a distance $offset_{hp}$. This is necessary in order to open the part of the slots cut into the sidewall of the HP waveguide.

Results of the electrical measurement.

After the design of the HP and VP radiators was inserted, it is necessary to evaluate the power of the two waveguides together. The adjustment and the directivity of this antenna are thus determined by electrical measurement.

Adjustment

As shown in FIG. 27, the adjustment is below −15 dB at approx. 600 MHz centered at 9.65 GHz.

FIG. 28 shows the insulation between H and V polarization. Sufficiently good values result which are far below the values typically required (e.g., <−40 dB).

Directivity

The measured directivities in azimuth at medium frequency of 9.65 GHz and the two peripheral frequencies of 9.35 and 9.95 GHz with a bandwidth of 600 MHz for HP and VP radiators are shown in FIG. 29 and FIG. 30.

| List of Reference Numbers | |
|---|---|
| 10 | Waveguide |
| 12 | Inner conductor |
| 14 | Slots |
| 16 | Feed point, feed |
| 18 | Coil section |
| 20 | Open end of the inner conductor |
| 22 | Straight segment |
| 24 | First curvature section |
| 26 | Coiled element of the curvature section |
| 28 | Straight element from a coil section |
| 30 | First and third curvature section |
| 32 | Second curvature section |

The invention claimed is:

1. A waveguide radiator comprising:

a slotted waveguide with a plurality of slots inserted in the waveguide; and a coiled inner conductor installed inside the waveguide, the coiled inner conductor being shaped in a polarization-dependent manner such that all of the slots of the waveguide can be excited with identical phase and amplitude.

2. The waveguide radiator according to claim 1, wherein the slotted waveguide is partially filled with a dielectric material on which the coiled inner conductor is arranged.

3. The waveguide radiator according to claim 1, wherein the coiled inner conductor is asymmetrical.

4. The waveguide radiator according to claim 1, wherein the slotted waveguide has transversal slots, whereby the waveguide is embodied in order to radiate horizontally polarized waves.

5. The waveguide radiator according to claim 4, wherein a feed of the waveguide is arranged asymmetrically in the longitudinal extension direction.

6. The waveguide radiator according to claim 5, wherein the feed of the waveguide is arranged in the same such that through the feed two waveguide sections are defined in which during operation of the waveguide a wave propagates with a phase difference of approx. 180° based on the center of the waveguide.

7. The waveguide radiator according to claim 4, wherein the coiled inner conductor comprises coil sections and a length and number of the coil sections are adapted to a spacing of the slots such that there is always a fixed number of coil sections between consecutive slots.

8. The waveguide radiator according to claim 7, wherein a straight segment of the coiled inner conductor is arranged between the feed point and a first coil section of the coiled inner conductor.

9. The waveguide radiator according to claim 4, wherein the coiled inner conductor has a straight inner conductor segment as an open line termination in the area of one end of the waveguide.

10. Phased array radiator with the following features:

a first waveguide radiator according to claim 4; and a second waveguide radiator.

11. The phased array radiator according to claim 10, wherein the first and second waveguide radiators are aligned longitudinally with respect to one another and have an identical length.

12. The waveguide radiator according to claim 4, wherein the coiled inner conductor has a coil section having a rotation angle $phi_h$ and a radius $x_h$, where $$x_h = \frac{mea_{w_h}^2 + mea_{l_h}^2}{4 \cdot mea_{w_h}}$$

$$phi_h = 2 \cdot \arctan\left(\frac{mea_{w_h}}{2 \cdot mea_{l_h}}\right)$$

holds true, where $mea_{wh}$ defines the width of the coiled inner conductor in the coil section and $mea_{lh}$ the length of the coiled inner conductor in the coil section.

13. The waveguide radiator according to claim 12, wherein the coiled inner conductor has a plurality of identical coil sections starting from a feed point arranged in a central area of the coiled inner conductor in the direction of the waveguide ends.

14. The waveguide radiator according to claim 1, wherein the slotted waveguide has slots arranged longitudinally, whereby the waveguide is embodied to radiate vertically polarized waves.

15. The waveguide radiator according to claim 14, wherein the coiled inner conductor has a feed point that is arranged centrally in the slotted waveguide and symmetrically to the slots.

16. The waveguide radiator according to claim 14, wherein the coiled inner conductor has a plurality of coil sections.

17. The waveguide radiator according to claim 16, wherein a coil section has a straight section and a curved section.

18. A waveguide radiator comprising:

a slotted waveguide with a plurality of slots inserted in the waveguide; and an inner conductor installed inside the waveguide, the inner conductor being shaped in a polarization-dependent manner such that all of the slots of the waveguide can be excited with identical phase and amplitude, wherein the slotted waveguide has slots arranged longitudinally, whereby the waveguide is embodied to radiate vertically polarized waves, the inner conductor has a coiled form with a plurality of coil sections, wherein a coil section has three curvature sections of which a first and third curvature section has respectively a first or third radius of curvature $x_1$ and a first or third angle of curvature $phi_{1v}$ according to $$x_1 = \frac{\left(\frac{mea_{w_v}}{2}\right)^2 + mea_{d_v}^2}{2 \cdot mea_{w_v}}$$

$$phi1_v = 2 \cdot \arctan\left(\frac{mea_{w_v}}{2 \cdot mea_{d_v}}\right)$$

and a second curvature section arranged between the first and third curvature section comprising two partial curvature sections with respectively one second radius of curvature $x_2$ and a second angle of curvature $phi_{2v}$ according to $$x_2 = \frac{mea_{w_v}^2 + mea_{d_v}^2}{4 \cdot mea_{w_v}}$$

$$phi2_v = 2 \cdot \arctan\left(\frac{mea_{w_v}}{mea_{d_v}}\right)$$

where $mea_{wv}$ defines a width of the additional inner conductor in the curvature section and $mea_{dv}$ defines a width of the curvature sections.

19. The waveguide radiator according to claim 18, wherein the inner conductor in the area of one end of the waveguide has an open line termination, which has to a part of a coil section with a first curvature section, followed by a straight conductor segment and further followed by a second curvature section and a further straight inner conductor segment.

20. Phased array radiator comprising:

a first waveguide radiator having a slotted waveguide with a plurality of slots inserted in the waveguide and an additional inner conductor installed inside the waveguide, wherein the inner conductor is shaped in a polarization-dependent manner such that all of the slots of the waveguide can be excited with identical phase and amplitude, and wherein the slotted waveguide has transversal slots, whereby the waveguide is embodied in order to radiate horizontally polarized waves; and a second waveguide radiator, wherein the first waveguide radiator is arranged horizontally and vertically offset with respect to the second waveguide radiator.

21. The phased array radiator according to claim 20, wherein an electrically conductive material is arranged in the area produced by the offset.

22. Synthetic aperture radar device, in particular a high-resolution synthetic aperture radar device, comprising a phased array radiator according to claim 20.

* * * * *